United States Patent [19]

Wilson

[11] Patent Number: 4,640,490

[45] Date of Patent: Feb. 3, 1987

[54] SPACER WASHER FOR CONCRETE FORM TIE RODS

[76] Inventor: T. Woodrow Wilson, 16th & Mica Rd., Box 1, Spokane, Wash. 99206

[21] Appl. No.: 840,687

[22] Filed: Mar. 18, 1986

[51] Int. Cl.[4] ..... E04G 17/06

[52] U.S. Cl. ..... 249/214; 249/41; 249/42; 249/217

[58] Field of Search ..... 249/40, 41, 42, 213, 249/214, 216, 217, 218

[56] References Cited

U.S. PATENT DOCUMENTS

| | | | |
|---|---|---|---|
| 1,293,391 | 2/1919 | Ewing | 249/214 |
| 1,701,601 | 11/1930 | Rohaut | 249/217 |
| 1,912,356 | 6/1933 | Beghetti | 249/46 |
| 2,069,085 | 2/1937 | Day | 249/42 |
| 2,190,700 | 2/1940 | Colt | 249/46 |
| 2,977,659 | 4/1961 | Buxton | 249/41 |
| 3,128,525 | 4/1964 | Kay | 249/217 |
| 3,327,988 | 6/1967 | Bridges | 249/213 |
| 3,430,913 | 3/1969 | Johnson | 249/217 |
| 3,437,306 | 4/1969 | Gates | 249/217 |
| 3,465,999 | 9/1969 | Gates | 249/217 |
| 3,490,730 | 1/1970 | Gates, Jr. | 249/216 |
| 3,618,887 | 11/1971 | Eriksson | 249/190 |
| 3,643,909 | 2/1972 | Brosseau | 249/41 |
| 4,006,878 | 2/1977 | Dawson et al. | 249/43 |
| 4,085,495 | 4/1978 | Hebert | 29/469 |
| 4,208,030 | 6/1980 | Wilson | 249/217 |

FOREIGN PATENT DOCUMENTS

| | | | |
|---|---|---|---|
| 1411948 | 10/1975 | United Kingdom | 249/217 |

*Primary Examiner*—Jay H. Woo
*Assistant Examiner*—James C. Housel
*Attorney, Agent, or Firm*—Keith S. Bergman

[57] ABSTRACT

A compound washer, for use with cylindrical concrete form tie rods having plural spaced flattened portions, that may be positioned by slidable motion along the tie rod and releasably maintained on a particular flattened portion against further lineal displacement. The washer provides a larger truncated conical body that threadedly engages and carries within its forward portion a fastening collar engaged on the flattened portion of a tie rod. The washer provides an elongate shape to create an indentation concrete to allow sub-surface breaking of a tie rod beneath a formed concrete surface.

4 Claims, 10 Drawing Figures

SPACER WASHER FOR CONCRETE FORM TIE RODS

BACKGROUND OF INVENTION

Related Applications

There are no applications related hereto now filed in this or any foreign country. The particular tie rod wire upon which my invention is used was disclosed in U.S. Pat. No. 4,208,030 heretofore issued to the instant inventor on June 7, 1980.

FIELD OF INVENTION

My invention relates generally to form spacer washers for the concrete forming arts and more particularly to such washers that are releasably engagable on continuous type tie rods having a plurality of alternating similar flattened and cylindrical portions.

DESCRIPTION OF THE PRIOR ART

In the existing concrete forming arts it has become common to use elongate tie rods to positionally maintain two parallel spaced form elements during the formation of a concrete wall therebetween. In this process it is convenient, and very nearly necessary, that the two forming elements be maintained in their spaced relationship prior to the filling of the space therebetween with concrete. Historically this function was generally accomplished in the earlier stages of the concrete forming arts by some sort of blocking that was removed during concrete pouring and generally during this time period the tie elements holding forms together were relatively flexible wires. In the more modern development of the concrete forming arts the tie elements have evolved into more rigid rod-like structures and the spacing of concrete form elements has been accomplished by some sort of a washer-like device that may be positioned on a rigid tie rod, inwardly of a forming surface, to prevent form displacement in an inward direction. Quite commonly with present day rigid form tie rods some sort of flattened or enlarged portion is provided to maintain washer positioning and allow other fastening. The instant invention is concerned with this type of tie rod and provides a new and novel member of the class of form tie spacer washers.

My spacer washer is particularly adapted for use with the continuous type of tie rod, disclosed in my prior U.S. Pat. No. 4,208,030, which provides plural alternating cylindrical and flattened portions so that the rod may be broken to length in the field.

Washers heretofore known for such tie rods have generally been of one of two types: the first providing an annular structure with a medial hole that is placed on the tie rod and moved axially therealong to some sort of protuberance or enlargement that maintains the washer against further motion in the same direction, and the second providing a "U" shaped device that is positioned on a thinner portion of a tie rod by a motion somewhat normal to the axis of the rod, to be there maintained against motion along the tie rod by larger portions of the rod on either side. The first type of spacer washer is not operative with the tie rod disclosed in my prior patent because the rod's enlarged portions are all of similar size so no one enlarged portion would maintain a washer and yet allow its motion along the rod over the other enlargements. The second type of washer has a disadvantage in that it is not positionally stable after placement and may quite readily be accidentally removed from a tie rod either during or after positioning of the form elements. In addition, the second class of "U" shaped type washer generally must have a somewhat limited dimension in the direction parallel to the tie rod because of requirements for its fastening, and this is often not desirable as generally a spacer washer should create an indentation in the finished concrete surface wherein a projecting tie rod end may be broken. To allow this type of tie rod breaking, a washer must be removed after wall formation and oftentimes "U" shaped washers have not been readily movable, if at all, from a set concrete surface.

To solve these problems my invention provides a compound washer which in essence combines the desirable features of the annular and the "U" shaped washers. I provide a smaller "U" shaped fastening washer that fits into a flattened portion of a tie rod and is then threadedly engaged in an annular recess defined in the nose of an elongate, somewhat bullet shaped, washer body to position the whole structure with stability and prevent displacement in either direction along a tie rod. The washer structure may form a hole in a concrete structure of almost any desired depth or size within which a projecting tie rod may be broken and which may be thereafter filled with cementuous material if desired. The body portion of my washer is provided with structure to aid its removal from the formed concrete mass and may be reused.

My invention lies not in any one of these features per se, but rather in the particular and unique synergistic combination of all of them in the structure specified to provide the uses and functions necessarily flowing therefrom.

SUMMARY OF INVENTION

My invention comprises a larger elongate washer body defining in its nose portion a chamber to threadedly receive the cylindrical periphery of a smaller "U" shaped fastening member that may be positioned on a flattened portion of a rigid tie rod element of a traditional concrete form structure.

The larger washer body defines a medial aligned channel to allow its passage along a tie rod positioned in that channel. The "U" shaped fastening member is positioned by lateral motion on a flattened portion of a tie rod, but is not movable in an axial direction therealong by reason of the tie rod shape. When the "U" shaped fastening member is carried within the washer body the combined structure may not be moved in either direction along the tie rod. The form facing base of the washer body defines structure to aid in extraction of the device from a hardened concrete mass.

In creating my invention it is:

A principal object to provide a releasably positionable spacer washer for a concrete form positionally maintained by tie rods having plural alternating similar flattened and cylindrical portions.

A further object to provide such a washer that is of compound nature to allow simple and easy placement but yet prevent dislodgment by accidental means.

A still further object to provide such a washer that defines plural holes in its exposed base to aid removal from a hardened concrete surface by use of a secondary tool.

A still further object to provide such a washer that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of changes in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figures 1, 2, 3, 4, 5, 6, 7, 8, 9, 10:
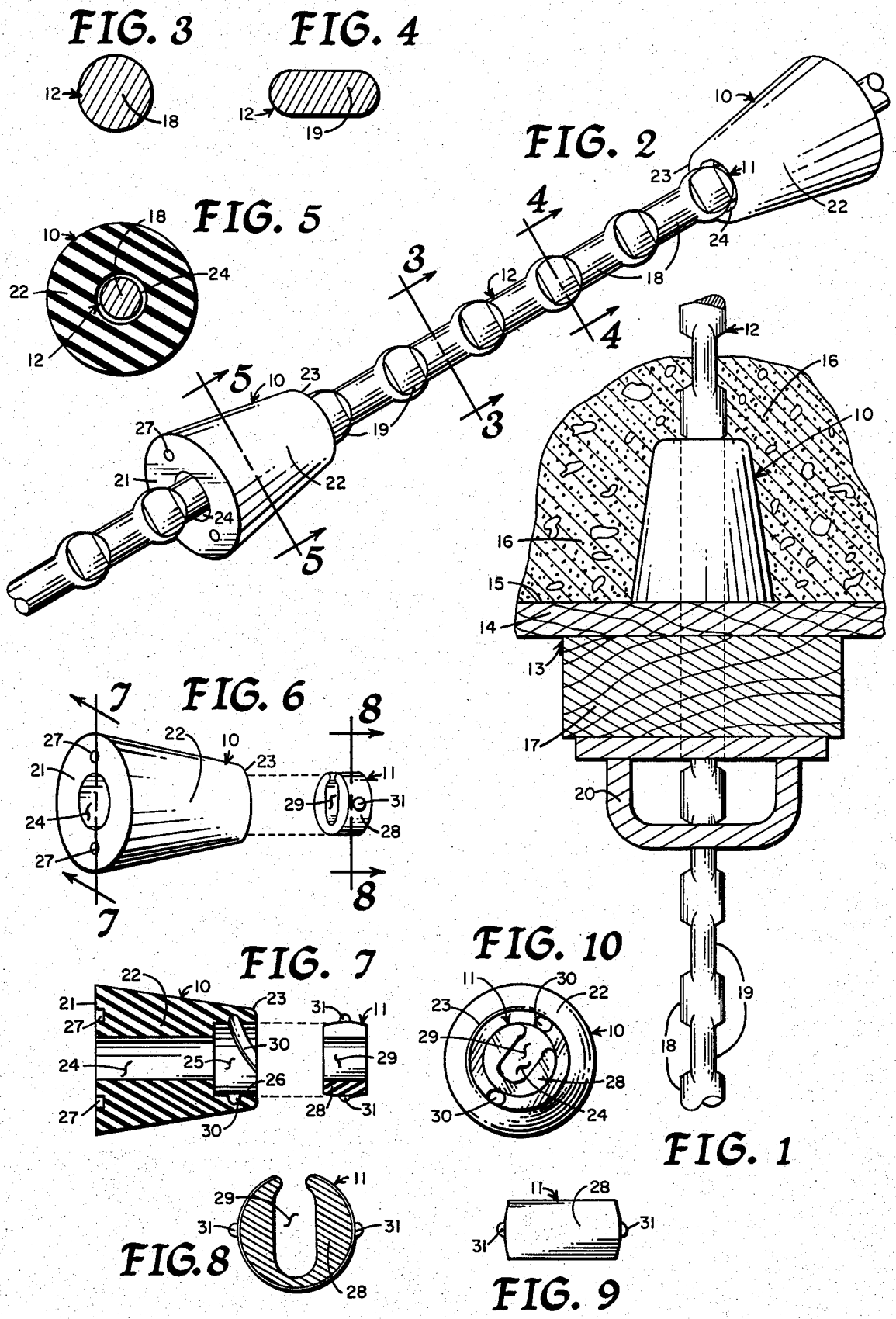
FIG. 1 is a partial, cut-away orthographic top view through a typical concrete form structure showing the positioning and use of my washer on a tie rod operatively embodied therein.
FIG. 2 is an isometric view of two of my washers in operative position on a section of tie rod of the type for which they were especially designed.
FIG. 3 is a cross-sectional view through the cylindrical portion of the tie rod of FIG. 2, taken on the line 3—3 thereon in the direction indicated by the arrows.
FIG. 4 is a cross-sectional view through the flattened portion of the tie rod of FIG. 2, taken on the line 4—4 thereon in the direction indicated by the arrows.
FIG. 5 is a cross-sectional view through the rearward portion of the washer body of FIG. 2, taken on line 5—5 thereon in the direction indicated by the arrows.
FIG. 6 is an expanded, isometric view of the washer body and "U" shaped fastening member showing their relationship and configuration.
FIG. 7 is a elongate vertical cross-sectional view through the washer of FIG. 6, taken on the line 7—7 thereon in the direction indicated by the arrows.
FIG. 8 is an elongate cross-sectional view through the fastening element of FIG. 6, taken on the line 8—8 thereon in the direction indicated by the arrows.
FIG. 9 is an orthographic side view of the fastening element.
FIG. 10 is an orthographic front view of my washer with the fastening element releasably positioned in the washer body.

My invention generally provides elongate washer body 10 defining a chamber in its nose portion to receive smaller fastening member 11 that is carried on tie rod 12 of form structure 13.

A portion of a typical form structure is seen in FIG. 1 to comprise form member 14 of some areal extent positioned to form the external surface 15 of concrete mass 16. Form member 14 is positionally maintained and strengthened by external reinforcing elements, normally vertical form studs 17 and horizontal walers (not shown). Form tie rod 12 interconnects two spaced, opposed form members 14 and extends through concrete mass 16 therebetween. The form tie rod comprises an elongate rigid rod defining alternating similar cylindrical portions 18 and flattened portions 19. The tie rod is releasably fastened by wedge-like clamps 20 externally of either the external surface of form members 14 or reenforcing elements 17, as the particular situation may require, to prevent those elements from spreading or moving away from each other. The opposed form members 14 are prevented from moving toward each other by my washers 10, 11. This structure in general is well known in the concrete forming arts and the particularly configured tie rod and fastening wedge illustrated are both disclosed in detail in U.S. Pat. No. 4,208,030 issued to the instant inventor on June 17, 1980. My invention proper resides in the compound washer formed by combination of washer body 10 and fastening member 11 as shown particularly in the drawings of FIGS. 6, et seq.

Washer body 10 is a surface of revolution peripherally defined by flat base 21, forwardly tapering sides 22 and flattened nose portion 23 to essentially create a truncated cylindrical cone. The washer body defines medial, axially aligned, cylindrical tie rod channel 24, of size adapted to slidably receive tie rod 12, and somewhat larger cylindrical fastening member chamber 25 communicating therewith in its forwardmost portion. Wall 26 defining the fastening member chamber is parallel to the axis of the annular washer body and provides internal threads 30 to releasably receive and threadedly engage the exterior surface of the fastening member therein. Plural spaced removal holes 27 are preferably defined in the base portion of the washer body to allow mechanical interconnection with a tool to aid removal of the washer from a finished concrete mass. Aside from the foregoing essentials the details of configuration and dimensioning of the washer body are not particularly critical to my invention. In ordinary concrete forming it is desirable that my washer have a length of about three-quarters of an inch to create an appropriate indentation in a formed concrete mass to allow breaking of a protruding form tie within that indentation. Obviously to allow removal, the washer body must have a configuration with each forward part having radial extension no greater than the immediately rearward part.

Fastening member 11 is a cylinder defining a diametrically orientated slot to create a "U" shaped cross-section, as shown in FIG. 8, with a peripheral size adapted to fit within fastening washer chamber 25 defined in the nose of the washer body 10. The external cylindrical surface of the fastening member defines thread elements, in the form illustrated nubbins 31, to operatively engage threads 30 of the fastening member chamber to allow releasably fastening of the members together. The fastening member defines tie rod slot 29 extending a substantial distance therein as illustrated in FIG. 7. This tie rod slot is appropriately sized to receive flat portion 19 of a tie rod therein and when the tie rod is so positioned to be substantially concentric about the axis of the tie rod. The thickness of the fastening washer, that is its dimension parallel to the axis of a tie rod to be serviced, is not critical but if it be substantially the same as that of the flat portion 19 of a tie rod to be serviced, when the fastening washer be placed on the flat portion it will not move substantially in either axial direction.

Both washer body 10 and fastening member 11 are formed of rigid material of appropriate strength to serve their purposes, preferably a moldable polymer for ease of manufacture. If these elements be formed from such a material that has some elastic resilience, the elements generally will have a longer life span and may be more readily removable from a solid concrete mass. Many polymeres and elastomeres of modern commerce fulfill this requirement.

Having thusly described the structure of my invention, its operation may be understood.

My spacer washer is particularly designed for use with tie rods of the type illustrated, having spaced flattened portions throughout their length, though the washer will operate with other tie rods having at least one flattened portion appropriately positioned for each spacer washer to be used. My washer obviously will not operate with the traditional type of modern day tie rods having preformed enlarged heads in their end parts with a uniformly sized medial rod therebetween.

To use my invention, a form structure is established with tie rods loosely placed between forms. A fastening member of my invention is then placed, from a lateral position, over the flat portion of a tie rod that is at or nearest to the position where it be desired to establish my washer. The larger washer body then is positioned so that the tie rod is carried within tie rod channel 24 with its nose pointing toward the "U" shaped fastening member that is to be associated with it. The washer body is then moved along the tie rod to the fastening member channel 25 and thence threadedly engaged with the fastening member. When in this position the assembled, compound washer will resist any further motion in either axial direction along the tie rod.

Commonly when a concrete structure is formed, such as the ordinary planar wall illustrated in FIG. 1, the two spaced opposed form elements 14 are positioned in opposition with paired cooperating holes defined in each to receive a tie rod therebetween. A tie rod is then inserted through one form element and a first washer body 10 placed over the end of the tie rod between the two form holes 14 with its base portion pointing toward the form element through which the tie rod has passed. A second annular washer body is then placed over the same end of the form tie, between the two form elements 14, pointing in the opposite direction. The form tie rod is thereafter positioned in the opposed cooperating hole in the opposite form element. Two fastening members 11 are then placed over the appropriate flat portions 19 of the tie rod between form elements 14 to position each fastening member 10 a spaced distance from the other so that their opposed bases will be the same distance apart as the thickness of the wall to be created. The annular washer bodies are then moved toward and threadedly engaged with each associated fastening member so that each fastening member is enclosed within fastening member chamber 25 of each washer body. This operation may require some appropriate lengthwise manipulation of the tie rod, depending upon whether the form elements are in relaxed or final position. After such placement fastening wedges 20 are positioned on the exterior surface of each opposed form structure and appropriately tightened to releasably fasten the form tie rods and interconnect the form structure.

The space between form elements 14 is then filled with plastic concrete in the ordinary fashion. When the concrete mass is set and conditions are appropriate for removal of the form structure, fastening wedges 20 are loosened and removed and the form structure stripped from both sides of the concrete mass. This will leave ends of tie rod 12 projecting from both surfaces of the formed concrete mass and will leave my washers 10, 11 embedded therein with the flat base 21 of each washer body 10 substantially co-planar with each surface of the concrete mass wherein it is contained. Washer bodies 10 may then be removed by manual manipulation with or without aid of ordinary hand tools or by means of a specialized tool particularly adapted for that purpose. After removal there will be a chamber or void where the annular washer body formerly was positioned and the tie rod projecting therethrough may be broken therein by use of the ordinary tools and manipulations heretofore known for such purpose. The void may thereafter be filled with some filling material as desired and heretofore known.

It is to be particularly noted from the foregoing description that the larger washer body 10, if carefully removed, may be re-used and, depending upon the nature of the material from which it is formed, this re-use might occur several times. Generally the smaller "U" shaped fastening member is expended and may not conveniently be recovered for re-use.

It is to be further noted that my spacer washer may be used with ordinary tie rod structures that have one flattened portion appropriately positioned for each spacer washer that is to be used. In general, however, the device is created for use with the type of continuous stock tie rod illustrated.

It is further to be noted that once my washer is placed in a traditional form structure of the type illustrated, it is very difficult to accidentally dislodge it since neither washer element will move in a direction along the tie rod in either direction. The structure may, however, be deliberately disassembled if desired before pouring of concrete by merely reversing the installation process.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A compound spacer washer for concrete form tie rods having a cylindrical body with at least one flattened portion for each washer to be carried thereby, comprising, in combination:

an elongate washer body, having planar base and axially inwardly tapering sides extending therefrom to communicate with a flattened nose portion, said washer body defining a medial tie rod channel extending axially therethrough to slidably receive a tie rod to be serviced, and a fastening member chamber larger than the medial tie rod channel in the nose portion thereof, said chamber having screw thread means defined on the internal wall of the chamber to threadedly receive a fastening member; and a cylindrical fastening member having means on a peripheral surface thereof for threadedly engaging said screw thread means within the fastening member chamber, a periphery configured to threadedly engage within the fastening member channel defined in the washer body, and defining a tie rod slot, extending from the periphery through the center of the fastening member and therebeyond, configured to be positionable upon the flat portion of the tie rod to be serviced but not movable axially therealong past the flat portion on which it is positioned.

2. The invention of claim 1 wherein the washer body has means for attachment of a tool to aid its removal from a formed concrete structure.

3. A compound spacer washer for a cylindrical concrete form tie rod having at least one spaced flattened portion, of lesser dimension in one cross-sectional direction than in the other perpendicular cross-sectional direction, for a washer to be carried thereon, said washer comprising, in combination:

a washer body formed as a surface of revolution with a planar base comprising the washer body's largest cross-section and each cross-section thereof more distal from the base having less radial extension than any cross-section closer to the base, said body defining an axially aligned cylindrical tie rod channel configured to allow the washer body to pass along a tie rod to be serviced and a larger axially aligned fastening member chamber defined in the end portion of said washer body opposite the base, said fastening member defining an internal chamber with threads defined in its peripheral surface; and a "U" shaped fastening member comprising a circular disc having peripheral defined means configured to threadedly engage within the fastening member chamber defined in the washer body and defining a tie rod slot therein, extending on a diameter from the periphery through the center to a spaced distance from the opposite periphery, said tie rod slot configured to fit upon a flattened portion of a tie rod but not pass in an axial direction therefrom.

4. The invention of claim 3 wherein the flat planar base of the annular washer body defines plural, spacedly arrayed holes to operatively receive a portion of a tool to aid removal of the washer body from a formed concrete surface.

* * * * *